US009335140B2

(12) United States Patent
Mitchell

(10) Patent No.: US 9,335,140 B2
(45) Date of Patent: May 10, 2016

(54) ARCHITECTURAL MESH BLAST SCREEN SYSTEM

(71) Applicant: CAMBRIDGE INTERNATIONAL INC., Cambridge, MD (US)

(72) Inventor: James J. Mitchell, Cambridge, MD (US)

(73) Assignee: CAMBRIDGE INTERNATIONAL, INC., Cambridge, MD (US)

( * ) Notice: Subject to any disclaimer, the term of this patent is extended or adjusted under 35 U.S.C. 154(b) by 7 days.

(21) Appl. No.: 14/218,151

(22) Filed: Mar. 18, 2014

(65) Prior Publication Data

US 2014/0261109 A1 Sep. 18, 2014

Related U.S. Application Data

(60) Provisional application No. 61/799,999, filed on Mar. 15, 2013.

(51) Int. Cl.

| | |
|---|---|
| ***F41H 5/013*** | (2006.01) |
| ***F41H 5/02*** | (2006.01) |
| ***F42D 5/045*** | (2006.01) |
| *F41H 5/24* | (2006.01) |

(52) U.S. Cl.

CPC ..... *F42D 5/045* (2013.01); *F41H 5/026* (2013.01); *F41H 5/24* (2013.01)

(58) Field of Classification Search

CPC ..... F41H 5/00; F41H 5/007; F41H 5/013; F41H 5/24; F41H 11/05; F41H 5/026

USPC ..... 89/36.04, 36.01, 918, 920

See application file for complete search history.

(56) References Cited

U.S. PATENT DOCUMENTS

| | | | | |
|---|---|---|---|---|
| 1,347,386 | A * | 7/1920 | Klein et al. | 16/256 |
| 1,417,084 | A * | 5/1922 | Maier | 16/305 |
| 1,418,919 | A * | 6/1922 | Hall | 16/286 |
| 1,487,233 | A * | 3/1924 | Glancey | 16/256 |
| 2,678,463 | A * | 5/1954 | Westphal | 16/299 |
| 2,715,241 | A * | 8/1955 | Carlson | 16/65 |
| 2,747,568 | A * | 5/1956 | Dupler | 126/531 |
| 5,205,015 | A * | 4/1993 | Huang | 16/50 |
| 5,915,449 | A * | 6/1999 | Schwartz | 160/330 |
| 6,659,155 | B1 * | 12/2003 | Mlenek et al. | 160/117 |
| 8,021,020 | B2 * | 9/2011 | Costello et al. | 362/249.15 |
| 8,365,803 | B2 * | 2/2013 | Schoenheit et al. | 160/330 |
| 8,881,640 | B2 * | 11/2014 | Errington et al. | 89/36.04 |
| 2003/0127122 | A1 * | 7/2003 | Gower | 135/87 |
| 2007/0180983 | A1 * | 8/2007 | Farinella et al. | 89/36.07 |
| 2010/0101404 | A1 * | 4/2010 | Lorenzo et al. | 89/36.04 |
| 2011/0048292 | A1 * | 3/2011 | Zimmer, II | 109/64 |
| 2011/0079135 | A1 * | 4/2011 | Farinella et al. | 89/36.02 |
| 2012/0011993 | A1 * | 1/2012 | Malone et al. | 89/36.02 |

(Continued)

FOREIGN PATENT DOCUMENTS

| | | | | |
|---|---|---|---|---|
| GB | 190711908 A * | 0/1907 | | E05F 1/1215 |

*Primary Examiner* — Jonathan C Weber

(74) *Attorney, Agent, or Firm* — Buchanan, Ingersoll & Rooney PC

(57) ABSTRACT

A blast screen system for a framed opening including a mounting mechanism secured to the framed opening; and a flexible mesh panel secured by the mounting mechanism to cover the framed opening. The mounting mechanism includes a plurality of spring biased brackets, each having a first portion and a second portion, the first and second portions being joined by a pivot pin.

11 Claims, 5 Drawing Sheets

(56) References Cited

U.S. PATENT DOCUMENTS

2012/0097018 A1* 4/2012 Schoenheit et al. ..... 89/36.02
2013/0014636 A1* 1/2013 Dehghanyar et al. ..... 89/36.02
2013/0186264 A1* 7/2013 Errington et al. ..... 89/36.04
2013/0200236 A1* 8/2013 Wood ..... 248/291.1

* cited by examiner

ARCHITECTURAL MESH BLAST SCREEN SYSTEM

TECHNICAL FIELD

The disclosure is directed to a blast protection system, and more particularly, to an architectural mesh blast screen system configured to protect personnel and property from debris resulting from an explosion while still allowing for ventilation and light and providing a pleasing aesthetic appearance.

BACKGROUND

Government buildings, embassies, and other public areas are often times the subject of tenor threats and terrorist attacks. Many of these attacks involve the use of explosives that produce both large amounts of debris and a pressure wave. Debris from the explosion can be created from the surroundings of the explosion. Debris may also be augmented by the bomb maker by including ball bearings, nails, and other objects with the explosive. The debris is driven at high speed by the pressure wave from the explosion and may cause physical injury to property and people.

In a common security scenario, an explosive detonates outside of a building. The explosion generates both a pressure shock wave and a blast wind. The shock wave carries debris outwardly, damaging property and people. When the shock wave from the explosion encounters a window or other opening, broken glass shards of the window or other material covering the opening may also be carried by the shock wave.

In order to provide protection from such explosions, barriers of various types have been deployed in order to reduce the damage and injury resulting from these attacks. Typically, these barriers include solid structures that block the damaging debris resulting from the explosion, but they also reduce the ventilation and the light that reaches the protected area. These types of barrier are particularly unsuited for use with windows or other openings, and are not amenable to easy cleaning and maintenance. These barriers also often times do not have a pleasing aesthetic appearance and are typically large and unwieldy. It is also possible for a solid barrier to cause additional damage if the shock wave overwhelms the barrier and damages the barrier.

It would be desirable to have a blast protection system which provides protection from the debris resulting from an explosion while also addressing the drawbacks discussed above.

SUMMARY

A blast screen system for a framed opening including a mounting mechanism secured to the framed opening; and a flexible mesh panel secured by the mounting mechanism to cover the framed opening. The mounting mechanism includes a plurality of spring biased brackets, each having a first portion and a second portion, the first and second portions being joined by a pivot pin.

BRIEF DESCRIPTION OF THE DRAWING FIGURES

These and other objects, features, and advantages will become more readily apparent to those skilled in the art upon reading the following detailed description, in conjunction with the appended drawings in which.

DETAILED DESCRIPTION OF THE PREFERRED EMBODIMENTS

Figure 1:
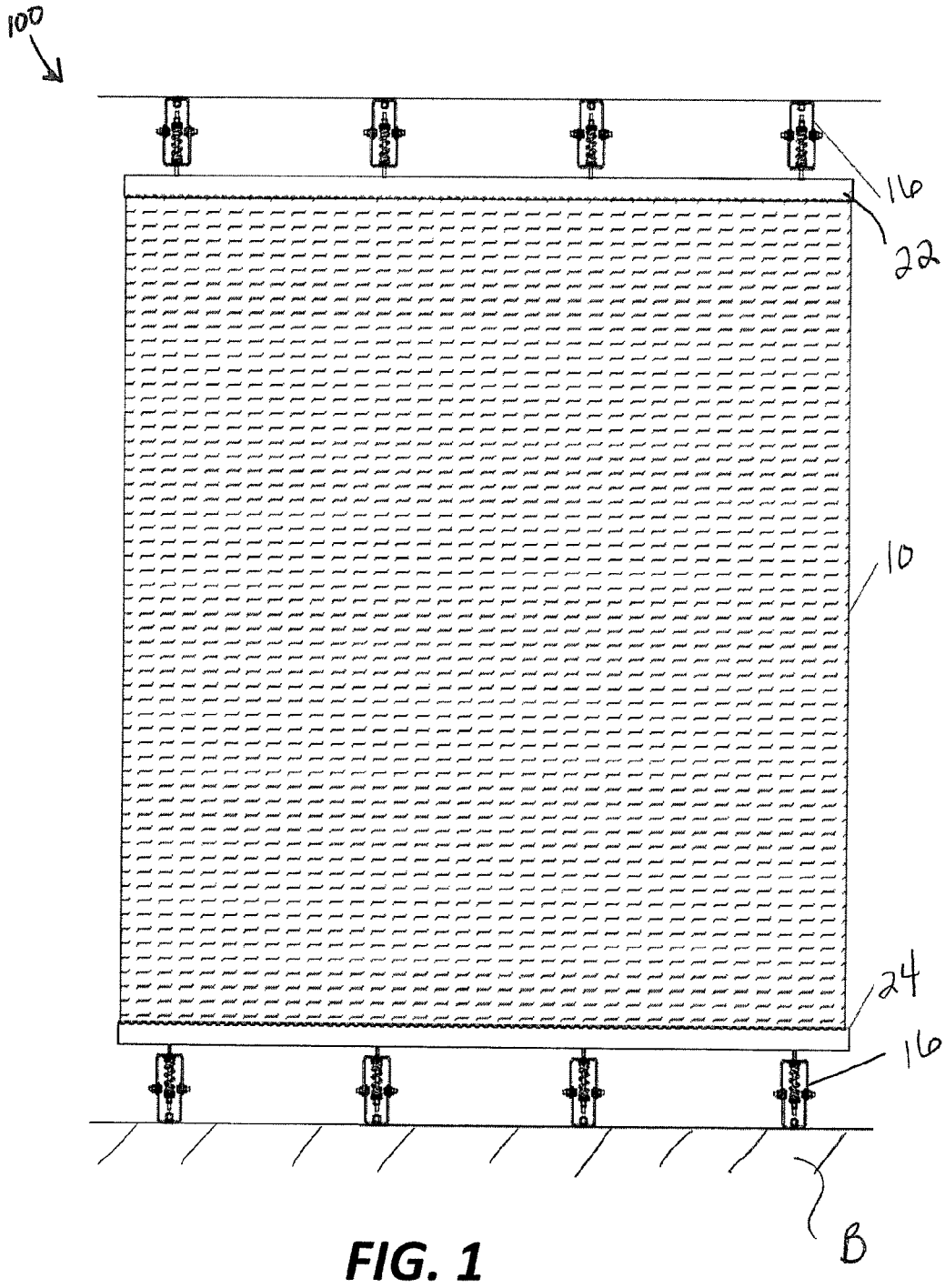
FIG. 1 is a front view of a blast screen system according to an exemplary embodiment disclosed herein.

The blast screen system 100, shown by exemplary embodiment in FIG. 1, preferably includes a mesh panel 10 which defines a blast screen having a predetermined width and height, upper and lower support tubes 22, 24, and mounting brackets 16. Top and bottom fascia guards (not shown) may also be provided. The mesh panel 10 is secured inside the support tubes 22, 24 which, in turn, are attached to the mounting brackets 16. The mounting brackets 16 include tension springs 26 which are configured to normally keep the mesh panel 10 straight and in tension. In a preferred installation, the brackets 16 are installed on the floor and ceiling of the areas to be protected.

Figure 2:
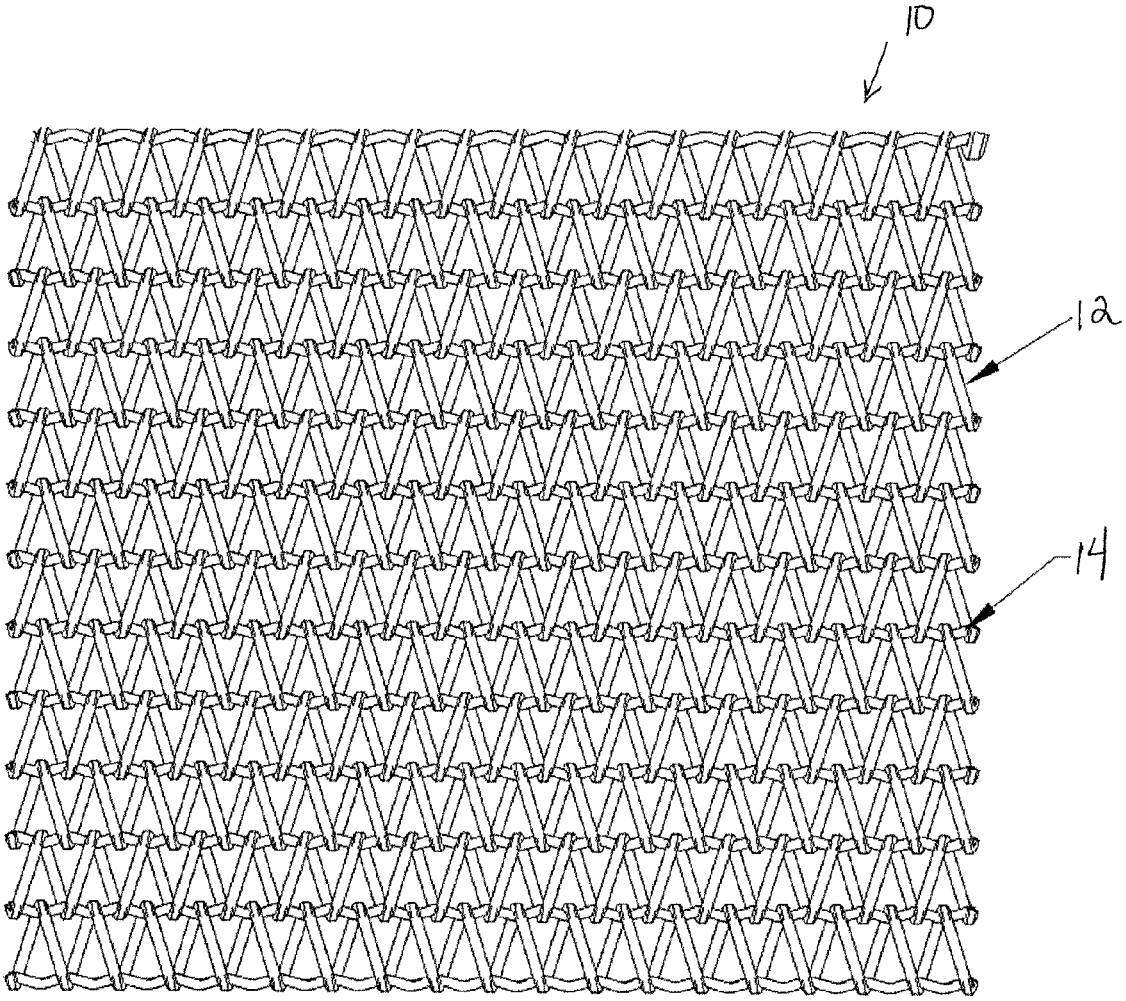
FIG. 2 is a fragmentary view of the mesh screen according to an exemplary embodiment disclosed herein.

One preferred embodiment of the mesh screen 10 is shown in detail in FIG. 2. The mesh screen 10 preferably comprises a flexible mesh fabric, and more particularly, an architectural mesh. The mesh screen 10 is formed of a plurality of helically-wound spiral wires 12, each of which is associated with two connector or crimp rods 14 positioned sequentially adjacent along the mesh screen 10. The combination of a helically-wound spiral wire 12 and two associated crimp rods 14 define a spiral unit having a plurality of vertically adjacent open recesses that allow ventilation and light to pass through. The mesh screen 10 is thus formed from a plurality of mesh spiral units joined together by their respective crimp rods 14, as depicted in FIG. 2. The ends of the crimp rods 14 may be fixed, preferably by welding, to make the assembly permanent.

Figure 3:
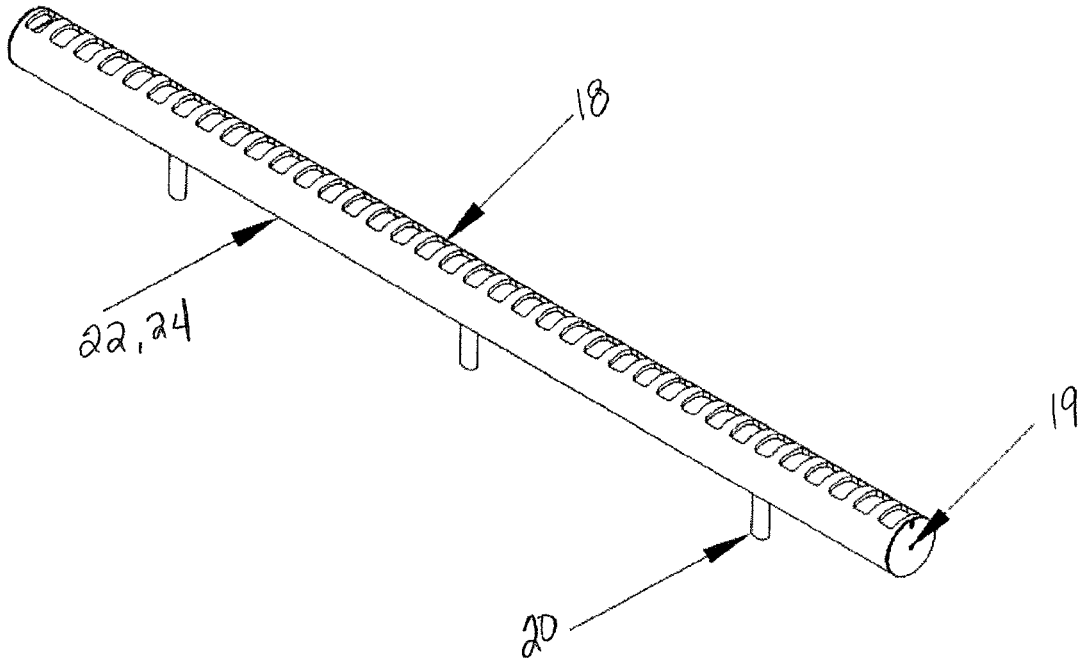
FIG. 3 is a perspective view of a support tube according to an exemplary embodiment disclosed herein.

The blast screen 10 is supported at the top and bottom by support tubes 22, 24, as shown in greater detail in FIG. 3. The tubes are preferably manufactured from 1½" schedule 40 tube (1.90 O.D.) in either grade T316 or T304 stainless steel. The mounting tubes 22, 24 have a plurality of apertures 18 cut along their length and sized to accept the spirals 12 of the mesh panel 10. The end spirals of the mesh panel 10 are inserted into the apertures 18 of the support tubes 22, 24. The spirals 12 are secured in the tubes 22, 24 by inserting a 10 gage straight rod (not shown) through the uppermost and lowermost mesh spiral to secure the mesh panel 10 in place. Tube caps 19 are attached to the ends of the tubes 22, 24 to secure the straight rods inside the tubes 22, 24. The support tubes 22, 24 have sections of threaded studs 20 welded at predetermined locations which are used to attach the tubes 22, 24 to the mounting brackets 16.

Figure 4:
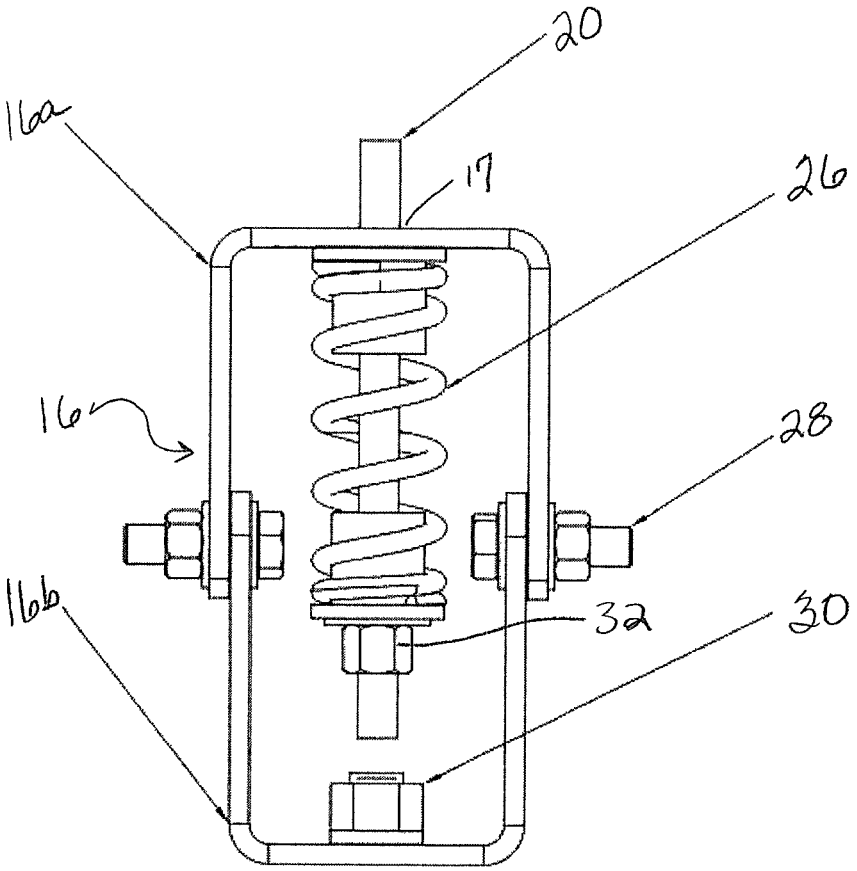
FIG. 4 is a schematic view of a mounting mechanism according to an exemplary embodiment disclosed herein.

Referring also to FIG. 4, the mounting brackets 16 are preferably fabricated from ¼" stainless steel plate in either T316 or T304 grades. The plates are cut and bent into final form defining first and second brackets 16*a*, 16*b*, which are joined together with pivot pins 28 to form an enclosed space. The support tubes 22, 24 are mounted to the mounting brackets 16 by inserting threaded studs 20 from the support tubes 22, 24 into slots 17 in the upper portion of one of the brackets 16*a*, 16*b* through a compression spring 26 disposed within the space enclosed by the brackets 16*a*, 16*b*, and securing with a fastening element 32, such as lock nuts and washers. The brackets 16 normally hold the blast screen 10 straight by applying pretension on the integral compression springs 26. This exerts a force on the support tubes 22, 24 keeping the mesh panel 10 under tension. The mounting side of the bracket 16 can be attached to the building structure B using appropriate mounting hardware 30, such as concrete anchors or bolted connections into structural steel, as needed.

In a preferred embodiment, the mesh screen 10 is formed from 18 gage (0.047) stainless steel wire of either T316 or T304 grades, however, the mesh screen 10 can be made of any material and/or weave desired to match the particular safety requirements. More particularly, the mesh screen 10 may be configured for a specific application by varying the open area per square foot of mesh as desired. This is done by adjusting the spread, or loops per foot in the horizontal direction, the pitch, or spirals per foot, the gauge of the wire of the crimp rods 14, or the gauge of the wire used to form the helically-wound spirals 12. The mesh screen 10 may be woven from a combination of spiral wires made of the same material or of two or more different materials. The spiral wires of the mesh screen may be of the same shape or size, or they may have different characteristics. Factors that may determine the composition and construction of the mesh screen 10 include the safety requirements of the building, the window glass type, the use of safety laminations, the expected threat level, and other factors.

Alternative embodiments of the screen system 100 may use other materials that also allow light and ventilation to enter but provides protection to property and people.

Figure 5:
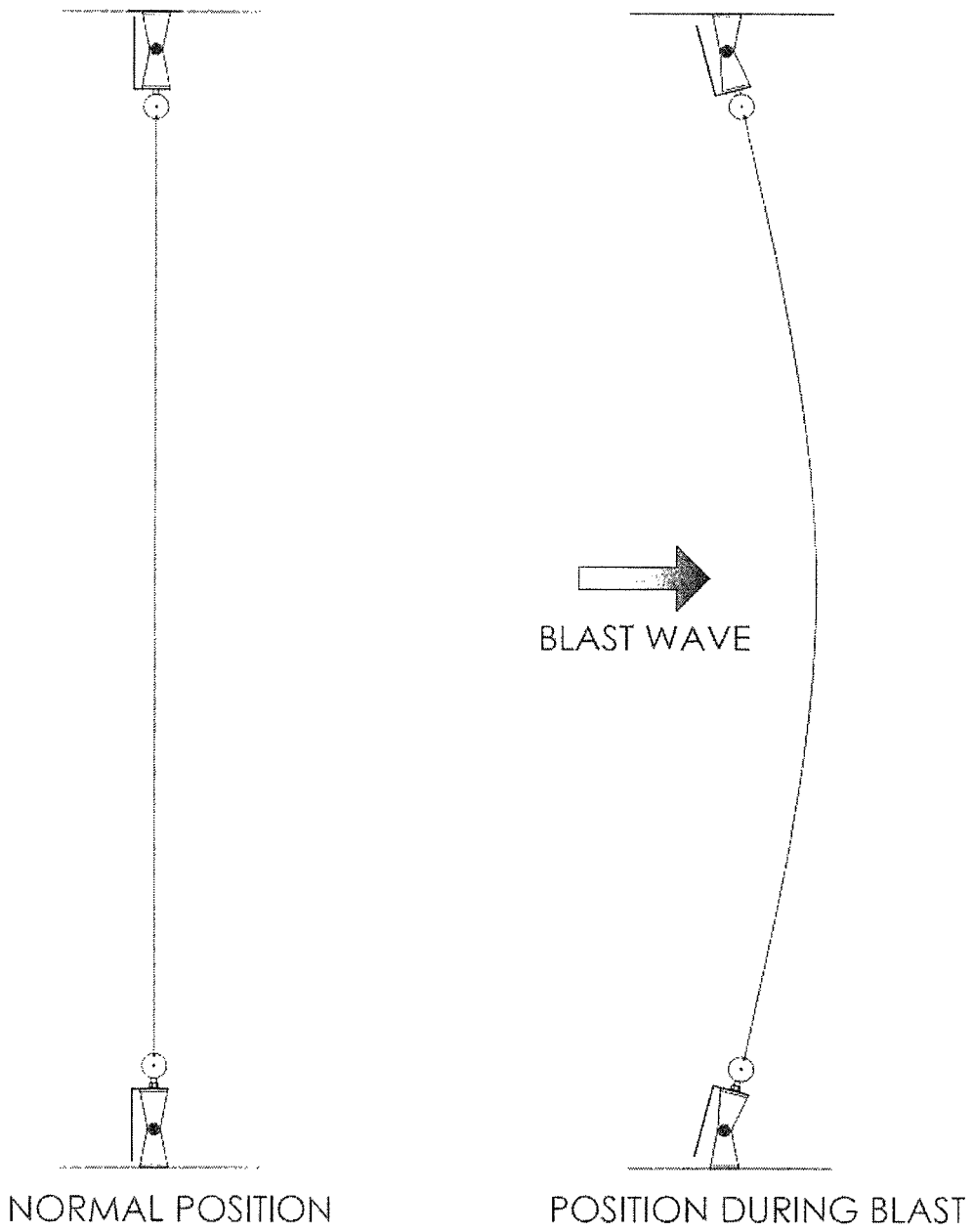
FIG. 5 is a schematic illustration of the operation of the blast screen system according to an exemplary embodiment disclosed herein.

The operation of the screen system 100 depicted in FIGS. 1-4 will now be described. In the event of a blast, the pressure wave from the explosion will implode the window driving glass shards and debris inward toward the occupied area. As shown in FIG. 5, the pressure wave will also cause the blast screen 10 to billow inward pivoting the mounting brackets 16 in the direction of the blast wave. The bracket tension springs 26 will compress allowing additional movement of the mesh panel 10. The open area of the screen 10 and flexibility of the system 100 will allow the blast pressure to vent while the close weave and strength of the mesh will trap glass shards and window debris. Thus, the pressure wave dissipates through the open area of the mesh screen 10 while the closed area of the mesh screen 10 traps the debris and prevents injury to property and people.

The above-described architectural mesh blast screen system 100 is designed to meet the standard established by the Department of State as outlined in performance condition 3A described in the specification GSA TS-01, level C, the contents of which are hereby incorporated by reference. This performance condition allows for glazing cracks and fragments to enter the occupied area of a building. The window debris and glass shards, however, are to land no further than 3.3 feet from the window. The described combination of features is specifically designed to offer protection for large windows and open areas such as building entrances, vestibules, and security screening checkpoints. Other applications are of course possible and within the scope of this disclosure.

While the disclosure set forth herein has been described with respect to a particular embodiment, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the claims.

What is claimed is:

1. A blast screen system for a framed opening comprising:

a mounting mechanism secured to the framed opening; and a flexible mesh panel secured by the mounting mechanism to cover the framed opening;

wherein said mounting mechanism includes a plurality of spring biased brackets, each having a first portion and a second portion, the first and second portions being joined by pivot pins and defining an open space therebetween;

wherein said mounting mechanism further includes a spring disposed within each said open space between the first and second portions; and an attachment stud extending through an interior of each said spring, the attachment stud being disposed perpendicular to the pivot pins joining the first and second portions and securing the flexible mesh panel to the framed opening.

2. The blast screen system of claim 1, wherein said mounting mechanism further comprises a first support for securing one edge of said mesh panel and a second support for securing a second edge of said mesh panel.

3. The blast screen system of claim 2, wherein said first and second supports include a plurality of apertures for receiving said respective edge of said mesh panel.

4. The blast screen system of claim 3, wherein said first and second supports include first and second tubes.

5. The blast screen system of claim 1, wherein each said spring biased bracket includes an opening for receiving the attachment stud.

6. The blast screen system of claim 5, wherein one of said first and second portions includes the opening, the attachment stud extending through the opening in said one of said first and second portions and being secured by a fastening element within said open space between the first and second portions.

7. The blast screen system of claim 1, wherein said mesh panel comprises a mesh fabric.

8. The blast screen system of claim 7, wherein said mesh fabric comprises a plurality of helically wound spiral wires and a plurality of connector rods interconnecting the helically wound spiral wires.

9. The blast screen system of claim 1, wherein, when a blast event occurs, the first portion of said spring biased bracket pivots about said pivot pin relative to the second portion of said spring biased bracket thereby allowing said mesh panel to billow in response to the blast event.

10. The blast screen system of claim 1, wherein said first and second portions are defined by generally U-shaped bent plates.

11. The blast screen system of claim 1, wherein the first and second portions each include two openings for receiving each of the pivot pins therethrough.

* * * * *